United States Patent [19]

Knobel et al.

[11] 4,247,290

[45] Jan. 27, 1981

[54] PROCESS FOR DYEING MIXED ELASTOMERIC AND NON-ELASTOMERIC FIBERS

[75] Inventors: Walter Knobel, Pratteln; Karl Zeller, Ettingen, both of Switzerland

[73] Assignee: Sandoz Ltd., Basel, Switzerland

[21] Appl. No.: 25,355

[22] Filed: Mar. 30, 1979

[30] Foreign Application Priority Data

Apr. 4, 1978 [CH] Switzerland ..... 3600/78

[51] Int. Cl.³ ..... D06P 3/26; D06P 3/40

[52] U.S. Cl. ..... 8/515; 8/516

[58] Field of Search ..... 8/21 B, 178 E, 21 R

[56] References Cited

U.S. PATENT DOCUMENTS 3,653,798 4/1972 Boardmann ..... 8/21 B

FOREIGN PATENT DOCUMENTS 2635989 2/1978 Fed. Rep. of Germany ..... 8/21 B

OTHER PUBLICATIONS

Dupont Bulletin L-57, Mar. 1968, pp. 9-22.

Ehlert, J., Man Made Textiles, Aug. 1964, pp. 45-49.

Frame, D. M., Amer. Dyestuff Reporter, Jun. 7, 1965, p. 36.

*Primary Examiner*—Joseph L. Schofer

*Assistant Examiner*—Maria S. Tungol

*Attorney, Agent, or Firm*—Gerald D. Sharkin; Richard E. Vila; Thomas C. Doyle

[57] ABSTRACT

A process for dyeing textile substrates comprising a mixture of elastomeric and non-elastomeric fibres, in which in a first step the elastomeric fibre portion is dyed by a cold dwell process and then in a second the non-elastomeric fibre portion is dyed by a conventional exhaust or continuous process.

10 Claims, No Drawings

PROCESS FOR DYEING MIXED ELASTOMERIC AND NON-ELASTOMERIC FIBERS

This invention relates to a two-step process for dyeing textile substrates comprising a mixture of elastomeric and non-elastomeric fibres.

It is known that elastomeric polyurethane fibres, for example Lycra, Elastan or Dorlastan (Registered Trade Marks) may be dyed at 80°-95° C. with acid dyes or their metal complexes, chrome or disperse dyes. Except where chrome dyestuffs are used, the resulting dyeings have only limited wet fastness. Particular difficulties arise in the dyeing of elastomeric polyurethane fibres in mixtures with natural or synthetic polyamides such as wool, silk or nylon, where both fibres are dyeable by the same types of dyestuffs, but have different rates of absorption and build-up, leading to non-level dyeings.

It is also known to dye such fibre mixtures in the presence of special chemical additives, for example mixtures of particular cationic and non-ionic substances. This does give improved dyeing of the elastomeric part, but has the disadvantage that it may give rise to precipitation of solids in circulation apparatus such as modified winchbecks and may also reduce the light fastness of the resulting dyeings. Furthermore, certain types of textiles, for example those containing twisted fibres with an elastomeric fibre core, e.g. Spanntex (Trade Mark) may not be sufficiently dyed in the elastomeric fibre portion. Besides, such processes are generally difficult to control.

The physical properties of textiles containing heat-sensitive elastomeric fibres are also adversely affected by prolonged treatment at temperatures near the boiling point, in that their desirable stretch property is diminished.

The present invention provides a process for dyeing textile substrates comprising a mixture of elastomeric and non-elastomeric fibres, in which in a first step the elastomeric fibre portion is dyed by a cold dwell process and then in a second step the non-elastomeric fibre portion is dyed by a conventional exhaust or continuous process.

The elastomeric fibre is a polyurethane fibre, and the non-elastomeric fibre may be any dyeable textile fibre, for example cellulose, polyacrylonitrile, polyester or, preferably, natural or synthetic polyamide, most preferably nylon 6 or nylon 66.

Suitable dyestuffs for dyeing the elastomeric fibre portion include acid dyes with one or more sulphonic acid groups, 1:1 metal complex dyes free of sulphonic acid groups, 2:1 metal complex dyes containing sulphonic acid groups, sulphonic acid-free 2:1 metal complex dyes, chrome dyes, disperse dyes and chlorine- and fluorine-containing reactive dyes. Examples of suitable dyes include:

C.I. Acid Yellow 196, C.I. Acid Orange 156, C.I. Acid Red 57, C.I. Acid Blue 72, C.I. Acid Brown 248, C.I. Acid Green 25, C.I. Acid Yellow 218, C.I. Acid Orange 67, C.I. Acid Orange 127, C.I. Acid Red 119, C.I. Acid Red 299, C.I. Acid Blue 280, C.I. Acid Blue 113, C.I. Acid Blue 278, C.I. Acid Red 261, C.I. Acid Red 263, C.I. Acid Violet 48, C.I. Acid Blue 247, C.I. Acid Green 28, C.I. Acid Yellow 80, C.I. Acid Yellow 129, C.I. Acid Red 217, C.I. Acid Brown 28, C.I. Acid Black 58, C.I. Acid Green 106, C.I. Acid Brown 363, C.I. Acid Blue 269, C.I. Acid Blue 193, C.I. Acid Blue 248, C.I. Acid Black 52.

C.I. Disperse Yellow 3, C.I. Disperse Orange 97, C.I. Disperse Yellow 49, C.I. Disperse Orange 3, C.I. Disperse Red 11, C.I. Disperse Red 17, C.I. Disperse Blue 27, C.I. Disperse Blue 56, C.I. Disperse Blue 79, C.I. Disperse Black 1. C.I. Reactive Yellow 11, C.I. Reactive Yellow 25, C.I. Reactive Yellow 41, C.I. Reactive Red 55, C.I. Reactive Red 123, C.I. Reactive Blue 52, C.I. Reactive Blue 79, C.I. Reactive Blue 113, C.I. Reactive Green 15, C.I. Reactive Black 34.

The cold-dwell process is carried out by padding or otherwise impregnating the substrate with the dye liquor in such a way as to give a controlled pick-up, preferably of from 70-300% of the weight of the substrate.

A particularly suitable machine for this purpose is sold under the name Carp-O-Roll (Trade Mark). The impregnated substrate is then stored for 1-48 hours, preferably 2-24 hours at a temperature of from 10°-80° C., preferably 20°-60° C. Preferably the substrate is rolled up, wrapped in plastic film and slowly rotated during storage.

During this dwell time the dyestuff diffuses into the elastomeric fibres and becomes fixed thereon, giving dyeings of a depth and fastness not obtainable by other methods. The rotation of the substrate gives level dyeings by preventing the formation of concentration differences. The dye liquor may contain additional wetting agents, and the use of acid generators may be desirable to regulate the pH value of the liquor.

In the second step of the process, the non-elastomeric fibre portion is further dyed, preferably in such a way as to give the same shade and depth of dyeing as that given to the elastomeric fibres in the first stage, that is, to give a tone-in-tone dyeing. If the non-elastomeric fibre requires a different type of dye from that used in the first step, and is therefore essentially undyed in the first step, it will generally be necessary to rinse the substrate and then to dye in the second step using a dye of the appropriate type carefully selected to match the shade and depth of the first dyeing.

Preferably, however, the non-elastomeric fibre is dyeable by the same dyestuff as that used in the first step. When this is the case, the non-elastomeric fibre portion will already be dyed to some extent in the first step, and the second step will generally use the same dyestuff in sufficient quantity to give the same depth of colour on both types of fibre. In this case a rinsing step will generally not be necessary, and the unfixed dyestuff left over from the first step contributes to the dyeing in the second step, and may even make it unnecessary to add further dyestuff.

The second step is preferably carried out by an exhaust process on a jigger, winchbeck, jet dyeing machine, overflow apparatus or star dyeing apparatus, using either a long or a short liquor-to-goods ratio (preferably between 3:1 and 20:1). The conditions used are conventional; for example for dyeing of synthetic polyamides with acid dyes, a temperature at or near the boiling point is used. Preferably the temperature does not exceed 105° C., and the dyeing time is no more than 3 hours, preferably no more than 1 hour. Conventional additives, for example levelling agents, may be used.

Surprisingly it is found that under these conditions there is little or no transfer of dye from the elastomeric fibre portion to the non-elastomeric fibres during the second dyeing step, even when a levelling agent is present. There is therefore no significant reduction in the depth of dyeing of the elastomeric fibres, and tone-in-tone dyeings may readily be obtained. Furthermore the fastness properties of the dyeing on the elastomeric fibre and the physical properties of the elastomeric fibres themselves are not significantly reduced by the second dyeing step, even when longer dyeing times are used.

The following Examples illustrate the invention. All percentages are by weight.

EXAMPLE 1:

A textile substrate of mixed polyamide/polyurethane fibres (Lycra, Dupont) (tulle fabric suitable for underwear) was padded at room temperature with an aqueous dye liquor of the following composition, the uptake being 110% by weight of the substrate:

1.6% C.I. Acid Orange 145
0.25% C.I. Acid Red 57
0.5% C.I. Acid Blue 40
0.3% of a commercial non-ionic wetting agent
1.0% 60% acetic acid.

The dyed goods were rolled up, wrapped with plastic film and rotated at 2–3 revs/min. for 20 hours at room temperature. A deep and level dyeing of the polyurethane fibres was obtained.

For the second step, the unrinsed goods were entered into an aqueous dyebath containing:

x% of the dyestuff mixture used above
4% ammonium sulphate
1% of a commercial levelling agent
1% 80% acetic acid at a liquor to goods ratio of 20:1, and dyed at the boil for 1 hour. Finally the goods were rinsed and dried. A good tone-in-tone dyeing was obtained. The value of x was determined by carrying out a sample dyeing.

EXAMPLE 2:

The textile fabric of Example 1 was padded at room temperature to give a 90% weight uptake of an aqueous dye liquor containing 0.6% C.I. Acid Orange 67
0.45% C.I. Acid Red 401
0.5% C.I. Acid Blue 280
0.4% commercial non-ionic wetting agent
1.0% 60% acetic acid.

The dyed goods were rolled up, wrapped in plastic film and rotated at 2–3 revs/min. for 20 hours at room temperature.

The second dyeing step was carried out as described in Example 1 using the same dye mixture as in the first step. An excellent tone-in-tone dyeing with deep and level shade was obtained.

EXAMPLE 3:

The textile fabric of Example 1 was padded at room temperature to give a 80% uptake of an aqueous dye liquor containing 1.2% C.I. Acid Brown 289
0.6% commercial non-ionic wetting agent
1.0% 60% acetic acid.

An optimum tone-in-tone effect was obtained in the second step without addition of further dyestuff by boiling the unrinsed goods for 1 hour in an aqueous solution of 4% ammonium sulphate
1% levelling agent and
1% 80% acetic acid at a liquor to goods ratio of 15:1, and finally rinsing and drying.

EXAMPLE 4:

The textile fabric of Example 1 was padded at room temperature to give a 80% uptake of an aqueous dye liquor containing 0.3% C.I. Disperse Yellow 3
0.6% C.I. Disperse Red 53
0.2% C.I. Disperse Blue 3
0.4% commercial non-ionic wetting agent
0.2% commercial weakly anionic wetting agent
1.0% 60% acetic acid.

The goods were rolled up, wrapped in plastic film and rotated at 2–3 revs/min. for 24 hours at 50° C.

The second dyeing step was carried out as described in Example 1, using the same dye mixture as in the first step, to give a tone-in-tone dyeing of the polyamide and polyurethane portions.

EXAMPLE 5:

The textile fabric of Example 1 was padded at room temperature to give a 90% uptake of an aqueous dye liquor containing 1.3% C.I. Disperse Orange 30
0.5% C.I. Disperse Red 73
0.8% C.I. Disperse Blue 79
1.0% commercial non-ionic wetting agent
1.0% 60% acetic acid.

The goods were rolled up, wrapped in plastic film and rotated at 2–3 revs/min. for 40 hours at room temperature.

A tone-in-tone dyeing was obtained by dyeing with the above mixture of dyes as described in Example 1.

What is claimed is:

1. A process for dyeing a textile substrate comprising a mixture of elastomeric and non-elastomeric fibers which comprises a first step of dyeing the elastomeric fiber portion by a cold dwell method wherein the substrate is impregnated with a dye liquor and then stored for 1 to 48 hours at a temperature of from 10° to 80° C., and a second step of dyeing the non-elastomeric fiber portion by an exhaust or continuous dyeing method.

2. A process according to claim 1 wherein, in the first step, the substrate is impregnated so as to give a dye liquor pick up of 70 to 300% based on the weight of the substrate.

3. A process according to claim 2 which comprises a first step consisting essentially of impregnating the substrate with a dye liquor suitable for dyeing the elastomeric fiber portion, rolling up the impregnated substrate, wrapping it in plastic film and rotating it during storage and a second step of exhaust dyeing the substrate with a dye suitable for dyeing the non-elastomeric fiber portion.

4. A process according to claim 3 wherein the exhaust dyeing is carried out at a temperature not exceeding 105° C. for not more than three hours.

5. A process according to claim 1 in which the non-elastomeric fibre is a natural or synthetic polyamide.

6. A process according to claim 1 in which the impregnated substrate is rolled up, wrapped in plastic film and rotated during storage.

7. A process according to claim 1 in which the second step is an exhaust dyeing.

8. A process according to claim 7 in which the exhaust dyeing is carried out at a temperature not exceeding 105° C. for not more than 3 hours.

9. A process according to claim 7 in which the same dyestuff or mixture of dyestuffs is used in the second step as in the first step.

10. A process according to claim 9 in which the second step dyeing is carried out using unfixed dyestuff left over from the first step, no further dyestuff being added.

* * * * *